US009027610B1

(12) United States Patent
Padovan

(10) Patent No.: US 9,027,610 B1
(45) Date of Patent: May 12, 2015

(54) NO-SPILL FUNNEL SYSTEM

(71) Applicant: Angelo Padovan, Hartsburg, MO (US)

(72) Inventor: Angelo Padovan, Hartsburg, MO (US)

( * ) Notice: Subject to any disclaimer, the term of this patent is extended or adjusted under 35 U.S.C. 154(b) by 27 days.

(21) Appl. No.: 14/146,762

(22) Filed: Jan. 3, 2014

(51) Int. Cl.
*B65B 39/00* (2006.01)
*B67C 11/02* (2006.01)

(52) U.S. Cl.
CPC ..... *B67C 11/02* (2013.01)

(58) Field of Classification Search
CPC ..... B67C 11/02
USPC ..... 141/199–205, 297–300, 331–343
See application file for complete search history.

(56) References Cited

U.S. PATENT DOCUMENTS

| | | | | |
|---|---|---|---|---|
| 4,850,403 | A * | 7/1989 | Wiese | 141/95 |
| 5,960,907 | A * | 10/1999 | Chau | 184/105.1 |
| 5,979,516 | A * | 11/1999 | Grant | 141/331 |
| 6,758,308 | B1 * | 7/2004 | Hearting et al. | 184/105.1 |

* cited by examiner

*Primary Examiner* — Jason K Niesz

(57) ABSTRACT

A funnel has a cylindrical upper first section with a first axial height and a first diameter, a cylindrical lower second section with a second axial height and a second diameter, and a frusto-conical intermediate section coupling the upper and lower sections and having a third axial height. Each of a plurality of similarly configured housings has a hollow cylindrical configuration forming cylindrical chambers, a housing axial height, a housing diameter, an upper end coupled to the intermediate section closer to the second section than to the first section, and a housing lower end at an elevation beneath the intermediate section laterally spaced from an upper extent of the second section. Each housing is adapted to removably receive and frictionally retain a magnet.

5 Claims, 2 Drawing Sheets

FIG. 1
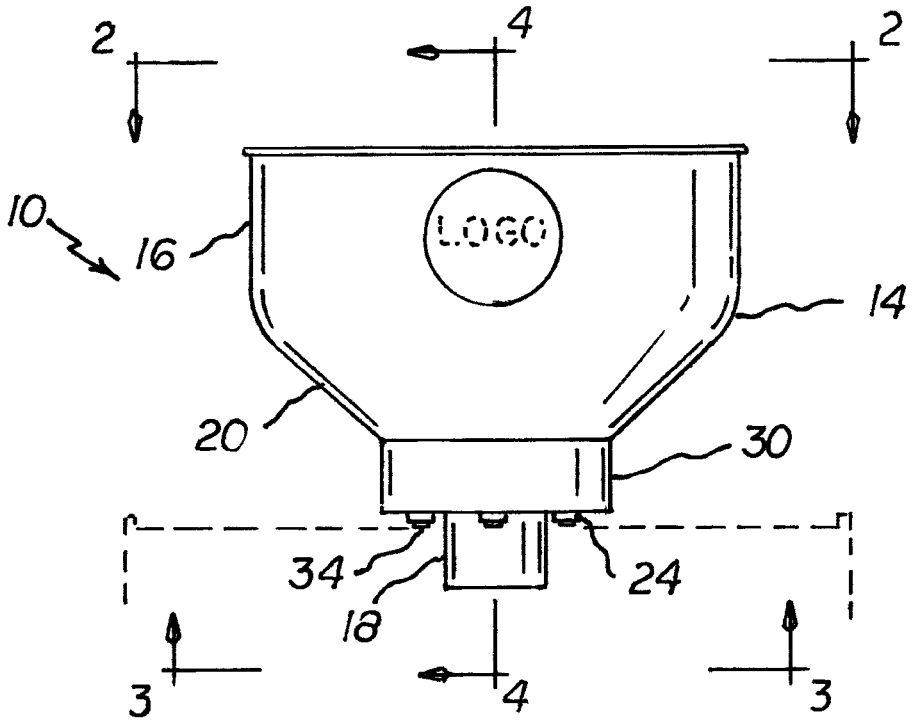
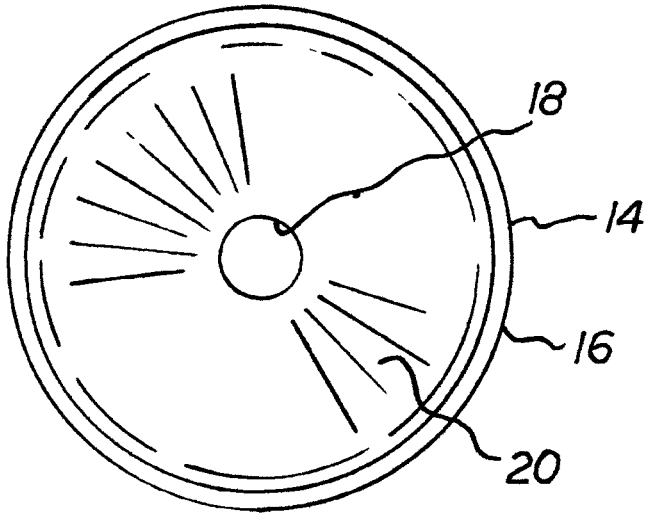
FIG. 2

FIG. 3
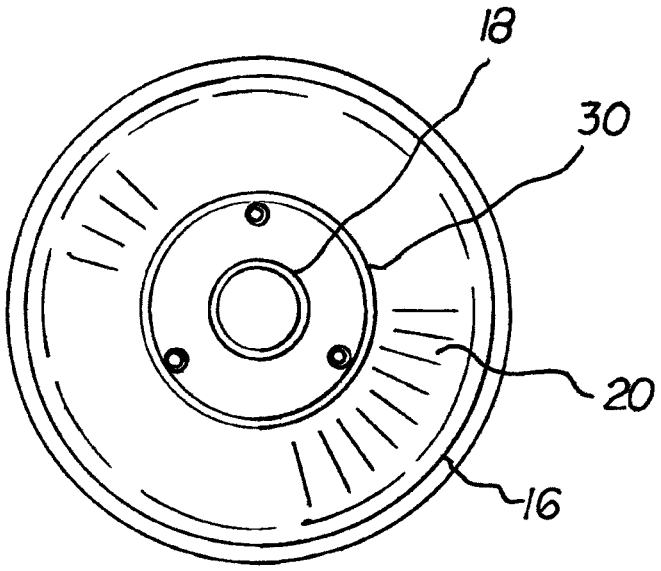
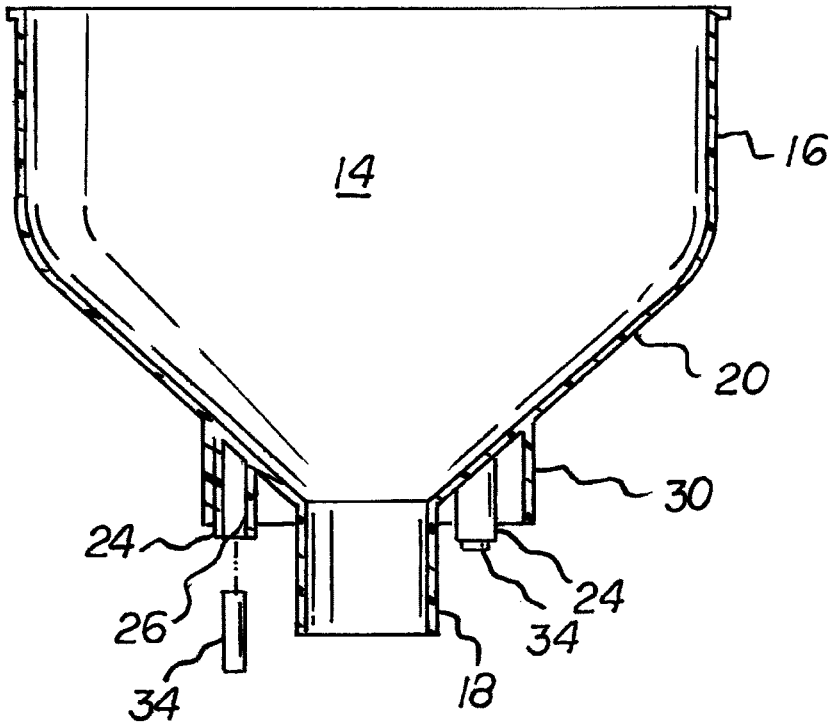
FIG. 4

NO-SPILL FUNNEL SYSTEM

BACKGROUND OF THE INVENTION

1. Field of the Invention

The present invention relates to a no-spill funnel system and more particularly pertains to the magnetic coupling to an apertured recipient surface while funneling a flow of a liquid, the coupling and funneling being done in a safe, convenient and economical manner.

2. Description of the Prior Art

The use of funnel systems is known in the prior art. More specifically, funnel systems previously devised and utilized for the purpose of preventing spills when using a funnel are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe no-spill funnel system that allows to the magnetic coupling to an apertured recipient surface while funneling a flow of a liquid, the coupling and funneling being done in a safe, convenient and economical manner.

In this respect, the no-spill funnel system according to the present invention substantially departs from the conventional concepts and designs of the prior art, and in doing so provides an apparatus primarily developed for the purpose of to the magnetic coupling to an apertured recipient surface while funneling a flow of a liquid, the coupling and funneling being done in a safe, convenient and economical manner.

Therefore, it can be appreciated that there exists a continuing need for a new and improved no-spill funnel system which can be used for to the magnetic coupling to an apertured recipient surface while funneling a flow of a liquid, the coupling and funneling being done in a safe, convenient and economical manner. In this regard, the present invention substantially fulfills this need.

SUMMARY OF THE INVENTION

In view of the foregoing disadvantages inherent in the known types of funnel systems now present in the prior art, the present invention provides an improved no-spill funnel system. As such, the general purpose of the present invention, which will be described subsequently in greater detail, is to provide a new and improved no-spill funnel system and method which has all the advantages of the prior art and none of the disadvantages.

To attain this, the present invention essentially comprises a funnel. The funnel has a cylindrical upper section. An upper first section has a first axial height. The first section has a first diameter. The funnel has a cylindrical lower second section. The second section has a second axial height. The second section has a second diameter. The funnel has a frusto-conical intermediate section. The intermediate section couples the first and second sections. The intermediate section has a third axial height.

A plurality of similarly configured housings is provided. Each housing has a hollow cylindrical configuration. In this manner cylindrical chambers are formed. Each housing has a housing axial height. Each housing has a housing diameter. Each housing has an upper end. The upper end is coupled to the intermediate section. The upper end and intermediate section are coupled closer to the second section than to the first section. Each housing has a housing lower end. The housing lower end is at an elevation beneath the intermediate section. The housing lower end is laterally spaced from an upper extent of the second section. Each housing is adapted to removably receive and frictionally retain a magnet.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved no-spill funnel system which has all of the advantages of the prior art funnel systems and none of the disadvantages.

It is another object of the present invention to provide a new and improved no-spill funnel system which may be easily and efficiently manufactured and marketed.

It is further object of the present invention to provide a new and improved no-spill funnel system which is of durable and reliable constructions.

An even further object of the present invention is to provide a new and improved no-spill funnel system which is susceptible of a low cost of manufacture with regard to both materials and labor, and which accordingly is then susceptible of low prices of sale to the consuming public, thereby making such no-spill funnel system economically available to the buying public.

Lastly, another object of the present invention is to provide a no-spill funnel system for to the magnetic coupling to an apertured recipient surface while funneling a flow of a liquid, the coupling and funneling being done in a safe, convenient and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a no-spill funnel system constructed in accordance with the principles of the present invention.

FIG. 2 is a plan view of the system taken along line 2-2 of FIG. 1.

FIGS. 3 and 4 are cross sectional views of the system taken along lines 3-3 and 4-4 of FIG. 1.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved no-spill funnel system embodying the principles and concepts of the present invention and generally designated by the reference numeral 10 will be described.

The present invention, the no-spill funnel system 10 is comprised of a plurality of components. Such components in their broadest context include a funnel and a plurality of similarly configured housings. Such components are individually configured and correlated with respect to each other so as to attain the desired objective.

First provided is a funnel 14. The funnel has an upper section 16. The upper section has a cylindrical configuration. The upper section has a first axial height. The upper section has a first diameter. The funnel has a lower section 18. The lower section has a cylindrical configuration. The lower section has a second axial height. The lower section has a second diameter. The funnel has an intermediate section 20. The intermediate section has a frusto-conical configuration. The intermediate section couples the upper and lower sections. The intermediate section has a third axial height. The intermediate section has the first diameter. The first diameter is between 6 and 8 times greater than the second diameter. The third axial length is greater than the first axial length. The first axial length is greater than the second axial length. The upper and lower and intermediate sections have a common central axis. The central axis is vertically oriented during use.

Three similarly configured housings 24 are provided. Each housing has a hollow cylindrical configuration. In this manner cylindrical chambers 26 are formed. Each housing has a housing axial height. Each housing has a housing diameter. Each housing has an upper end. The upper end is coupled to the intermediate section. The upper end is coupled to the intermediate section closer to the second section than to the first section. Each housing has a housing lower end. The housing lower end is provided at an elevation beneath the intermediate section. Each housing lower end is laterally spaced from an upper extent of the second section. Each chamber has a diameter. The diameter of each chamber is between 15 percent and 25 percent of the second diameter. The chambers have parallel secondary axes. The secondary axes are provided parallel with and equally spaced from the central axis. The housings are circumferentially spaced at 120 degrees from each other.

A shroud 30 is provided next. The shroud has a hollow cylindrical configuration. The shroud has a shroud axial height. The shroud has a shroud diameter. The shroud has an upper end. The upper end of the shroud is coupled to the intermediate section. The upper end of the shroud is coupled to the intermediate section closer to the second section than to the first section. The shroud has a shroud lower end. The shroud lower end is provided at an elevation beneath the intermediate section but above the housing lower ends. The shroud lower end is laterally spaced from an upper extent of the second section. The shroud diameter is between 15 percent and 25 percent of the second diameter. The chambers have parallel secondary axes. The secondary axes are provided parallel with and equally spaced from the central axis. The housings are circumferentially spaced at 120 degrees from each other. The shroud essentially encompasses the housings. The housings are circumferentially closer to the shroud than to the second section.

Provided last is a magnet 34 which, in the preferred embodiment, is positioned in each housing. Each magnet has a cylindrical configuration. Each magnet has a magnet diameter. The magnet is to be received and frictionally retained in an associated housing. Each magnet has a magnet axial length. The axial length of each magnet is greater than the housing axial length. In this manner a minor extent of each magnet extends beneath an associated housing. An apertured recipient surface 38 is provided. The system is positionable in the apertured recipient surface. The surface is of a metallic material, such as an internal combustion engine. The lower section extends through the apertured recipient surface. The magnets secure the system with respect to the apertured recipient surface while oil is poured through the first and third and second sections of the system.

In the preferred embodiment, the three magnets are neodymium magnets and the remainder of the system funnel and housings and shroud are fabricated of HDPE, high density polyethylene. Variations on the materials as well as the sizes and proportions as shown are variable as a function of the particular application.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A no-spill funnel system comprising:

a funnel having a cylindrical upper first section with a first axial height and a first diameter, the funnel having a cylindrical lower second section with a second axial height and a second diameter, the funnel having a frusto-conical intermediate section coupling the first and second sections and having a third axial height; and a plurality of similarly configured housings, each housing having a hollow cylindrical configuration forming cylindrical chambers, each housing having a housing axial height and a housing diameter, each housing having an upper end coupled to the intermediate section closer to the second section than to the first section, each housing having a housing lower end at an elevation beneath the intermediate section laterally spaced from an upper extent of the second section.

2. The system as set forth in claim 1 wherein each housing is adapted to removably receive and frictionally retain a magnet.

3. The system as set forth in claim 2 and further including:

a shroud having a hollow cylindrical configuration, the shroud having a fifth axial height and a shroud diameter, the shroud having an upper end coupled to the intermediate section closer to the second section than to the first section, the shroud having a shroud lower end at an elevation beneath the intermediate section but above the housing lower ends, the shroud lower end being laterally spaced from an upper extent of the second section, the housings being equally spaced circumferentially from each other, the shroud essentially encompassing the housings with the housings being circumferentially closer to the shroud than to the second section.

4. The system as set forth in claim 1 and further including:

a magnet in each housing, each magnet having a cylindrical configuration and of a magnet diameter to be removably received and frictionally retained in an associated housing, each magnet having a magnet axial length greater than the housing axial length whereby a minor extent of each magnet extends beneath an associated housing, the system being positionable in an apertured recipient surface of a metallic material such as an internal combustion engine with the third section extending through the apertured recipient surface and with the magnets securing the system with respect to the apertured recipient surface while oil is poured through the first and third and second sections of the system.

5. A no-spill funnel system for (10) magnetically coupling to an apertured recipient surface while funneling a flow of a liquid, the coupling and funneling being done in a safe, convenient and economical manner, the system comprising, in combination:

a funnel (14) having an upper section (16), the upper section having a cylindrical configuration with first axial height and a first diameter, the funnel having a lower section (18), the lower section having a cylindrical configuration with second axial height and a second diameter, the funnel having an intermediate section (20), the intermediate section having a frusto-conical configuration coupling the upper and lower sections, the intermediate section having a third axial height, the first diameter being between 6 and 8 times greater than the second diameter, the third axial length being greater than the first axial length, the first axial length being greater than the second axial length, the upper and lower and intermediate sections having a common central axis vertically oriented during use;

three similarly configured housings (24), each housing having a hollow cylindrical configuration forming cylindrical chambers (26), each housing having a housing axial height and a housing diameter, each housing having an upper end coupled to the intermediate section closer to the second section than to the first section, each housing having a housing lower end at an elevation beneath the intermediate section, each housing lower end being laterally spaced from an upper extent of the second section, each chamber having a diameter between 15 percent and 25 percent of the second diameter, the chambers having parallel secondary axes, the secondary axes being parallel with and equally spaced from the central axis, the housings being circumferentially spaced at 120 degrees from each other;

a shroud (30) having a hollow cylindrical configuration, the shroud having a shroud axial height and a shroud diameter, the shroud having an upper end coupled to the intermediate section closer to the second section than to the first section, the shroud having a shroud lower end at an elevation beneath the intermediate section but above the housing lower ends, the shroud lower end being laterally spaced from an upper extent of the second section, the shroud diameter between 15 percent and 25 percent of the second diameter, the chambers having parallel secondary axes, the secondary axes being parallel with and equally spaced from the central axis, the housings being circumferentially spaced at 120 degrees from each other, the shroud essentially encompassing the housings with the housings being circumferentially closer to the shroud than to the second section; and a magnet (34) in each housing, each magnet having a cylindrical configuration and of a magnet diameter to be received and frictionally retained in an associated housing, each magnet having a magnet axial length greater than the housing axial length whereby a minor extent of each magnet extends beneath an associated housing, the system being positionable in an apertured recipient surface (38) of a metallic material such as an internal combustion engine with the lower section extending through the apertured recipient surface and with the magnets securing the system with respect to the apertured recipient surface while oil is poured through the first and third and second sections of the system.

* * * * *